US007546924B2

(12) United States Patent
Oliveira

(10) Patent No.: US 7,546,924 B2
(45) Date of Patent: Jun. 16, 2009

(54) DISPLAY CARTON

(75) Inventor: Steven Manuel Oliveira, Nashua, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 387 days.

(21) Appl. No.: 11/172,500

(22) Filed: Jun. 30, 2005

(65) Prior Publication Data

US 2007/0000806 A1 Jan. 4, 2007

(51) Int. Cl.
*B65D 75/00* (2006.01)
*B65D 5/00* (2006.01)

(52) U.S. Cl. ..... 206/784; 206/763; 206/765; 206/766; 206/769; 206/775; 206/822; 229/122; 229/162.1

(58) Field of Classification Search ..... 206/769, 206/756, 763, 765, 766, 784, 775, 779, 822; 229/149, 122, 115, 162.1, 120.08, 120.13
See application file for complete search history.

(56) References Cited

U.S. PATENT DOCUMENTS 1,317,162 A * 9/1919 Heppe ..... 206/744
1,501,016 A * 7/1924 Young ..... 206/765
2,372,747 A * 4/1945 Sullivan ..... 43/121
2,419,510 A * 4/1947 Van Rosen ..... 229/115
2,643,811 A 6/1953 Bolding
2,894,673 A * 7/1959 Vuillemenot ..... 229/113
3,144,191 A * 8/1964 Saidel ..... 229/212
3,322,263 A 5/1967 Gulliver
3,389,850 A 6/1968 Rockefeller
3,471,006 A * 10/1969 Tempelhof ..... 206/449
3,493,104 A * 2/1970 Tempelhof ..... 206/775
3,679,093 A 7/1972 Chang
3,987,893 A 10/1976 Hanson
4,355,758 A 10/1982 Lavery
4,562,922 A * 1/1986 Midura ..... 206/781
D293,212 S 12/1987 Zuliani
4,930,637 A 6/1990 DeRoseau
5,375,700 A 12/1994 Joss et al.
5,379,886 A 1/1995 Brauner et al.
5,458,235 A 10/1995 Stone
5,540,330 A * 7/1996 Lo Duca ..... 206/446
5,566,878 A 10/1996 Peiffer et al.
5,607,058 A 3/1997 Huesman et al.
D386,078 S 11/1997 Harper et al.
5,907,944 A 6/1999 Giacoman
D425,413 S 5/2000 Heeley et al.

(Continued)

OTHER PUBLICATIONS

U.S. Design Patent Application No. 29/233,334; filed Jun. 30, 2005; In re: Steven Manuel Oliveira, entitled *Carton*.

*Primary Examiner*—J. Gregory Pickett
(74) *Attorney, Agent, or Firm*—Womble Carlyle Sandridge & Rice, PLLC

(57) ABSTRACT

A carton includes a base panel, a rear panel extending upwardly from a rear edge of the base panel, a right side panel extending forwardly from a right side edge of the rear panel, a left side panel extending forwardly from a left side edge of the rear panel, a cavity at least partially positioned between the right and left side panels for at least partially containing the article, and an at least generally forwardly facing upper panel that extends downwardly and forwardly away from an upper edge of the rear panel, and obliquely with respect to the rear panel.

37 Claims, 17 Drawing Sheets

U.S. PATENT DOCUMENTS

| | | | | |
|---|---|---|---|---|
| D427,524 | S | 7/2000 | Weisz | |
| D430,610 | S | 9/2000 | Jones | |
| 6,173,833 | B1 | 1/2001 | Strehlow | |
| 6,206,750 | B1 | 3/2001 | Barad et al. | |
| D440,488 | S | 4/2001 | Thompson et al. | |
| D446,113 | S | 8/2001 | Steinfels | |
| 6,298,990 | B1 | 10/2001 | Amrod et al. | |
| D449,979 | S | 11/2001 | Planchard | |
| D463,274 | S | 9/2002 | Green | |
| 6,470,653 | B1 | 10/2002 | Lutz et al. | |
| 6,474,539 | B1 * | 11/2002 | Van Der Horst | 206/756 |
| D479,853 | S | 9/2003 | Hwang et al. | |
| 6,644,473 | B2 | 11/2003 | Kohler | |
| 6,679,029 | B2 | 1/2004 | Clay | |
| 6,802,415 | B2 | 10/2004 | Loeffler | |
| 6,823,988 | B2 | 11/2004 | Ryan et al. | |
| 6,935,509 | B2 * | 8/2005 | Egresitz | 206/756 |
| D532,690 | S * | 11/2006 | Oliveira | D9/431 |
| 2002/0088730 | A1 | 7/2002 | Galomb | |
| 2004/0163986 | A1 | 8/2004 | Pinyot | |
| 2006/0254954 | A1 | 11/2006 | Wright | |

* cited by examiner

DISPLAY CARTON

BACKGROUND OF THE INVENTION

A wide variety of cartons are known. There is always a desire for cartons that provide a new balance of properties.

BRIEF SUMMARY OF SOME ASPECTS OF THE INVENTION

One aspect of the present invention is the provision of a carton including a container portion and a cover portion. The container portion defines a cavity for at least partially containing at least one article. The container portion can include first and second border panels that are respectively positioned proximate opposite first and second sides of an opening to the cavity. Each of the first and second border panels can face at least generally in a first direction (e.g., forwardly) that is away from the cavity.

The cover portion can be moved between closed and opened configurations for opening and closing the cavity with at least a cover panel of the cover portion. The cover panel includes opposite inner and outer sides. The inner side of the cover panel faces toward the cavity while the cover portion is in the closed configuration. The outer side of the cover panel faces at least generally in the first direction (e.g., forwardly) that is away from the cavity while the cover portion is in the closed configuration. The cover portion can at least partially fit between the border panels while the cover portion is in the closed configuration. The cover panel can define an opening that extends through the cover panel for providing at least visual access to the cavity while the cover portion is in the closed configuration. Each of the first and second border panels can extend obliquely with respect to the cover panel while the cover portion is in the closed configuration.

In accordance with one aspect of the present invention, the container portion further includes a base panel and a rear panel that extends upwardly from a rearward end of the base panel. Each of the first and second border panels can extend upwardly and rearwardly from proximate a forward end of the base panel, and obliquely with respect to the base panel. The cover portion can be pivotably connected a forward end of the base panel. An upwardly open receptacle can be adjacent the base panel for holding at least one article in the cavity.

According to one aspect of the present invention, the container portion further includes a third border panel positioned proximate a third side of the opening to the cavity. The third border panel can extend from proximate an end of the first border panel to proximate an end of the second border panel. The third border panel can face at least generally in the first direction (e.g., forwardly) that is away from the cavity. The first and second boarder panels can be coplanar with respect to one another, and the third border panel can be coplanar with the first and second boarder panels.

According to one aspect of the present invention, the third boarder panel extends downwardly and forwardly from the upper end of the rear panel, and obliquely with respect to the rear panel, so that the container portion defines an upwardly pointing top. The cover portion can further include an end panel. The end panel extends downwardly and rearwardly from an end of the cover panel, and obliquely with respect to the cover panel, while the cover portion is in the closed configuration, so that the cover portion defines an upwardly pointing top while the cover portion is in the closed configuration. In a side view of the carton in the closed configuration, the third boarder panel of the container portion and the end panel of the cover portion can extend downwardly convergently toward one another so that a recess is defined between the top of the container portion and the top of the cover portion. This recess can function as a feature that enables a user to easily open the carton.

In accordance with one aspect of the present invention, a blank for forming a carton includes a central panel and first, second, third and fourth pluralities of panels. The central panel can have opposite first and second edges, and opposite third and fourth edges. The first plurality of panels can be arranged in series with respect to one another and respectively foldably connected to one another by a first plurality of fold lines. A first panel of the first plurality of panels can be foldably connected to the first edge of the central panel. Fold lines of the first plurality of fold lines can extend obliquely with respect to the first edge of the central panel.

The second plurality of panels can be arranged in series with respect to one another and respectively foldably connected to one another by a second plurality of fold lines. A first panel of the second plurality of panels can be foldably connected to the second edge of the central panel. Fold lines of the second plurality of fold lines can extend obliquely with respect to the second edge of the central panel.

The third plurality of panels can be arranged in series with respect to one another and respectively foldably connected to one another by a third plurality of fold lines. A first panel of the third plurality of panels can be foldably connected to the third edge of the central panel. Similarly, the fourth plurality of panels can be arranged in series with respect to one another and respectively foldably connected to one another by a fourth plurality of fold lines. A first panel of the fourth plurality of panels can be foldably connected to the fourth edge of the central panel.

Other aspects and advantages of the present invention will become apparent from the following.

BRIEF DESCRIPTION OF THE DRAWINGS

Having described some aspects of the invention in general terms, reference will now be made to the accompanying drawings, which are not necessarily drawn to scale, and wherein.

DETAILED DESCRIPTION

Referring now in greater detail to the drawings, in which like numerals refer to like parts throughout the several views, an exemplary embodiment of the present invention is described in the following.

Figure 7:
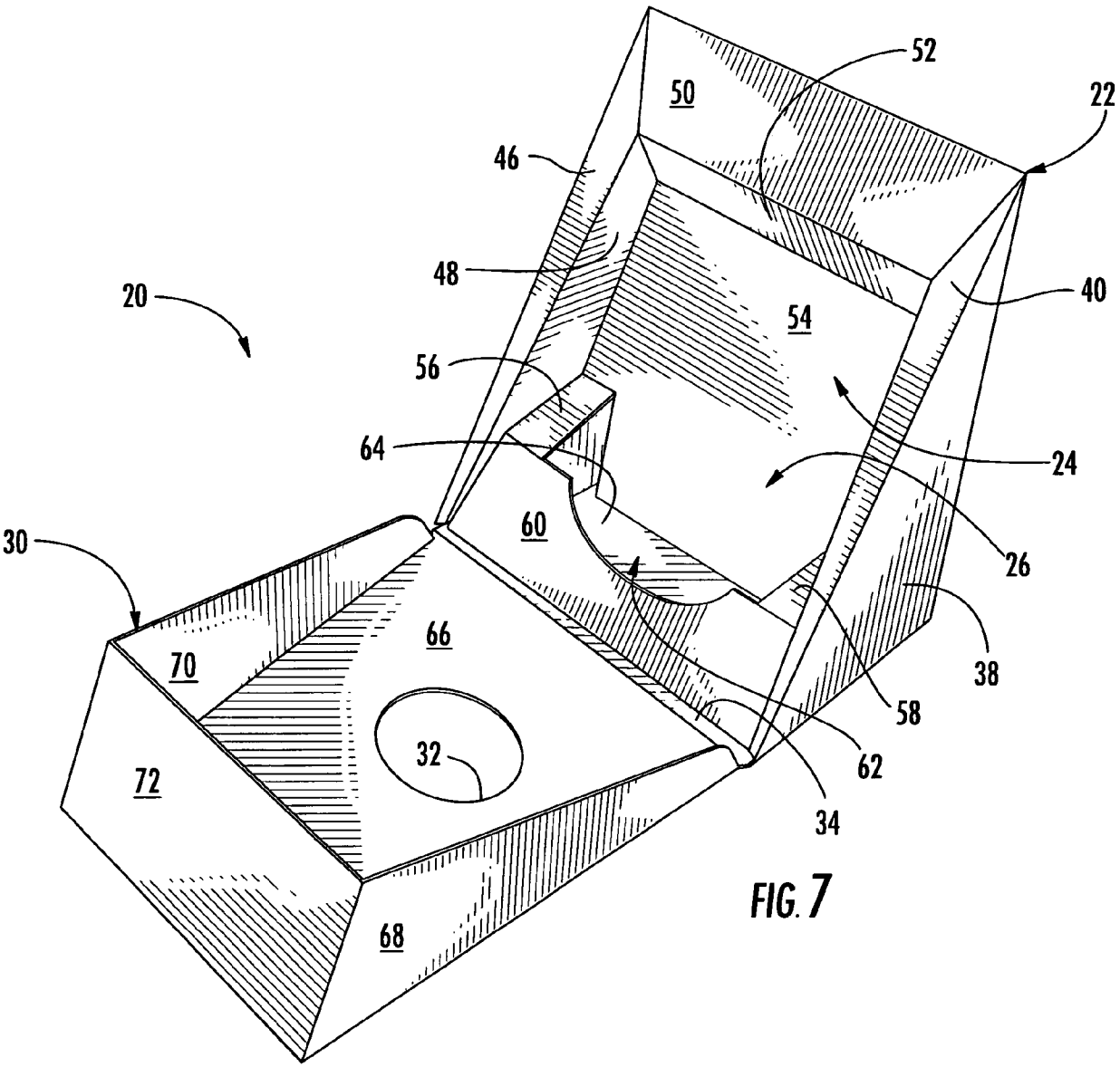
FIG. 7 is a right perspective view of the carton in the open configuration, with a left perspective view of the carton in the open configuration being a mirror image of FIG. 7, in according with the exemplary embodiment of the present invention.
Figure 8:
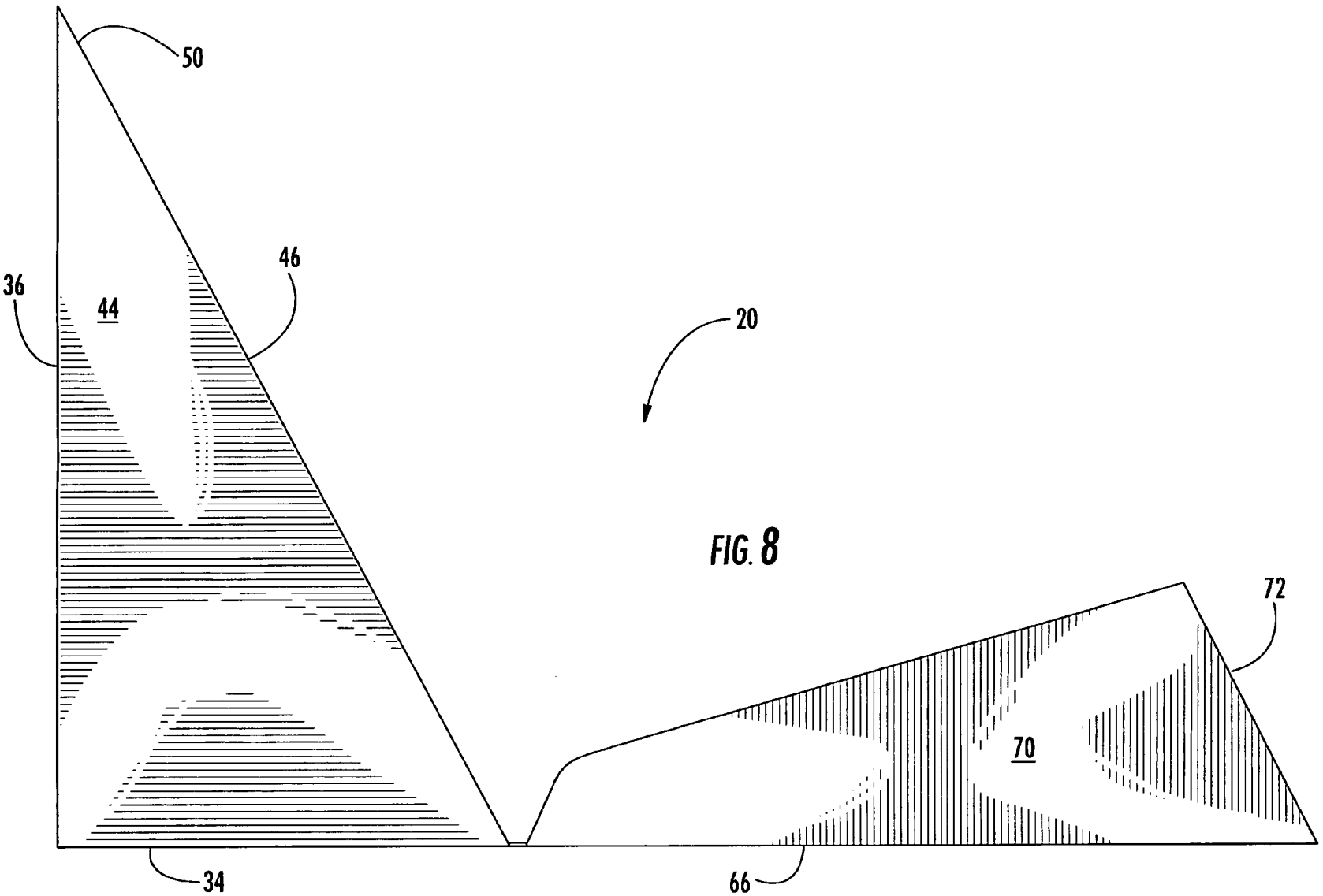
FIG. 8 is a left elevation view of the carton in the open configuration, wherein a right elevation view of the carton in the open configuration is a mirror image of FIG. 8.
Figure 9:
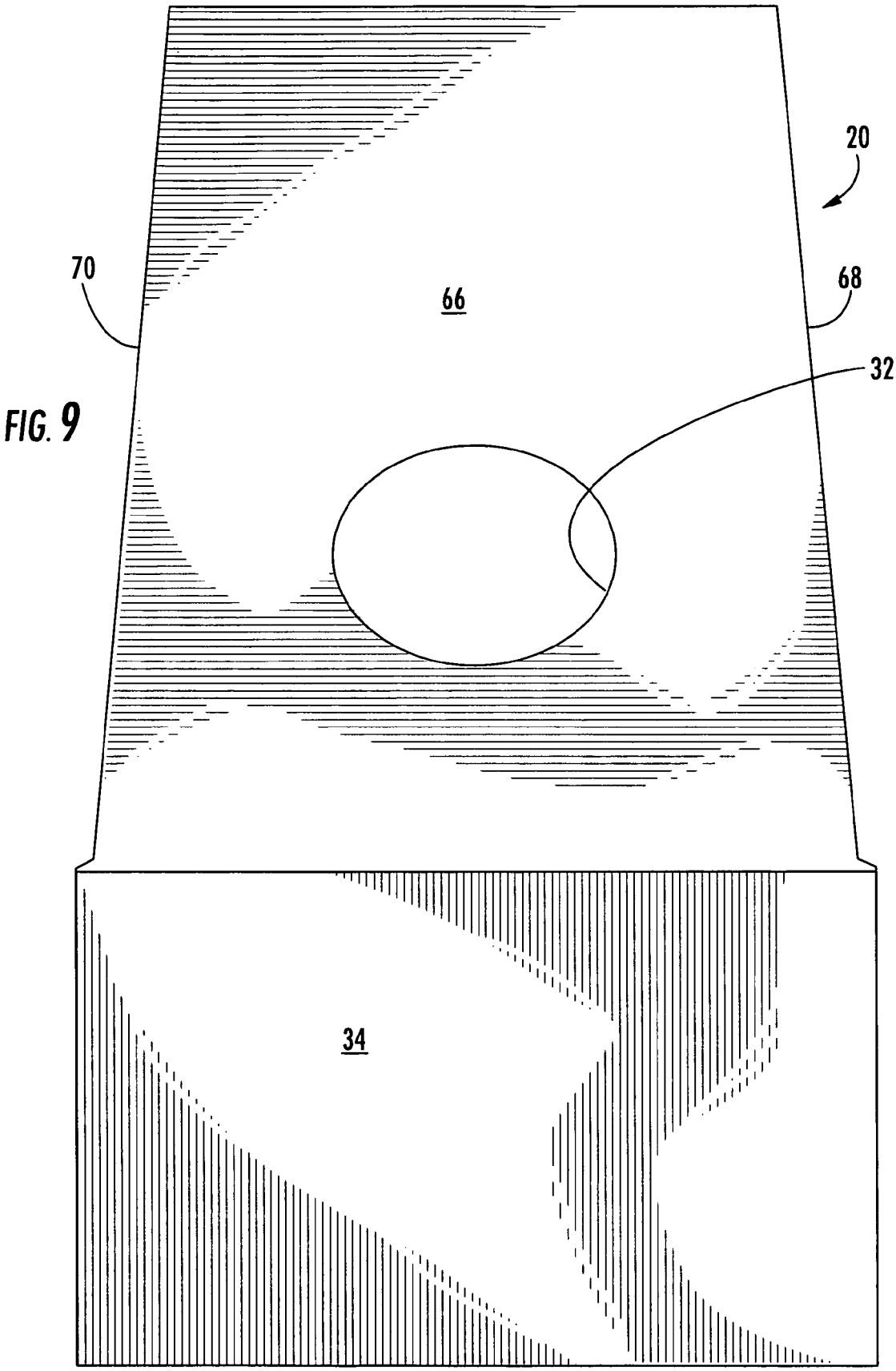
FIG. 9 is a bottom plan view of the carton in the open configuration.
Figure 12:
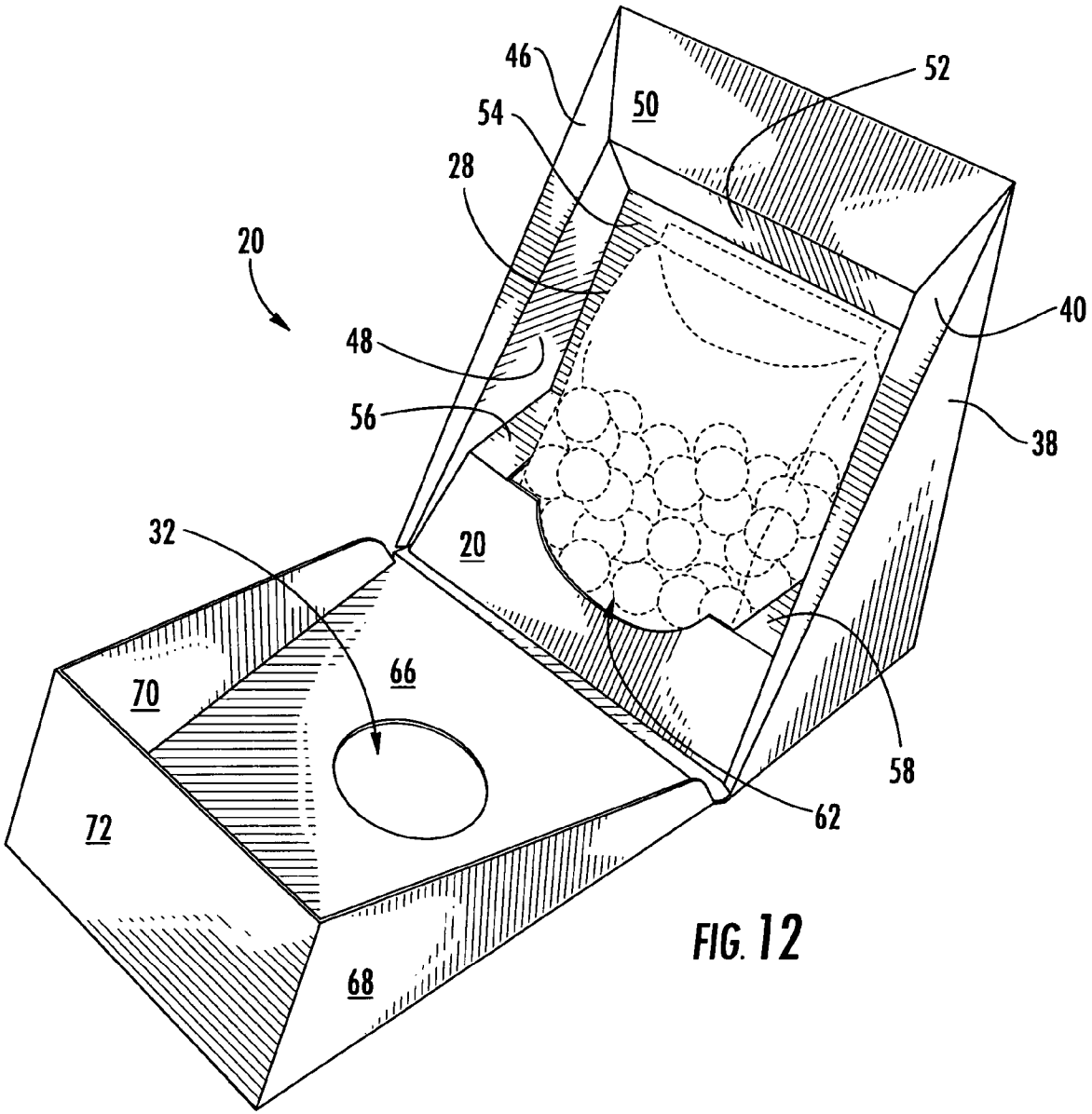
FIG. 12 is another right perspective view of the carton in the open configuration, with the carton containing a bag of articles that is illustrated by broken lines, wherein another left perspective view of the carton is a mirror image of FIG. 12.

As best understood with reference to FIG. 7, a carton 20 of an exemplary embodiment of the present invention includes a container portion 22 having a cavity 24 and a receptacle 26. As best understood with reference to FIG. 12, the receptacle 26 can receive one or more articles 28, and releasably hold the articles in the cavity 24. The article(s) are illustrated by broken lines in FIG. 12. For example, the article 28 can be a bag of candy or a wide variety of other types of articles. The receptacle 26 can be omitted or reconfigured to accommodate different types, shapes, and/or sizes of articles 28, or the like.

In accordance with the exemplary embodiment of the present invention, the carton 20 further includes a cover portion 30 for opening (e.g., see FIG. 7) and closing (e.g., see FIG. 1) the cavity 24. The cavity 24 or one or more articles 28 within the cavity can be viewed through the cover's viewing opening 32 while the carton is closed. The cover's viewing opening 32 can be a wide variety of difference shapes, it can be covered (e.g., with a material such as a transparent material (not shown)), or it can be omitted.

Figure 3:
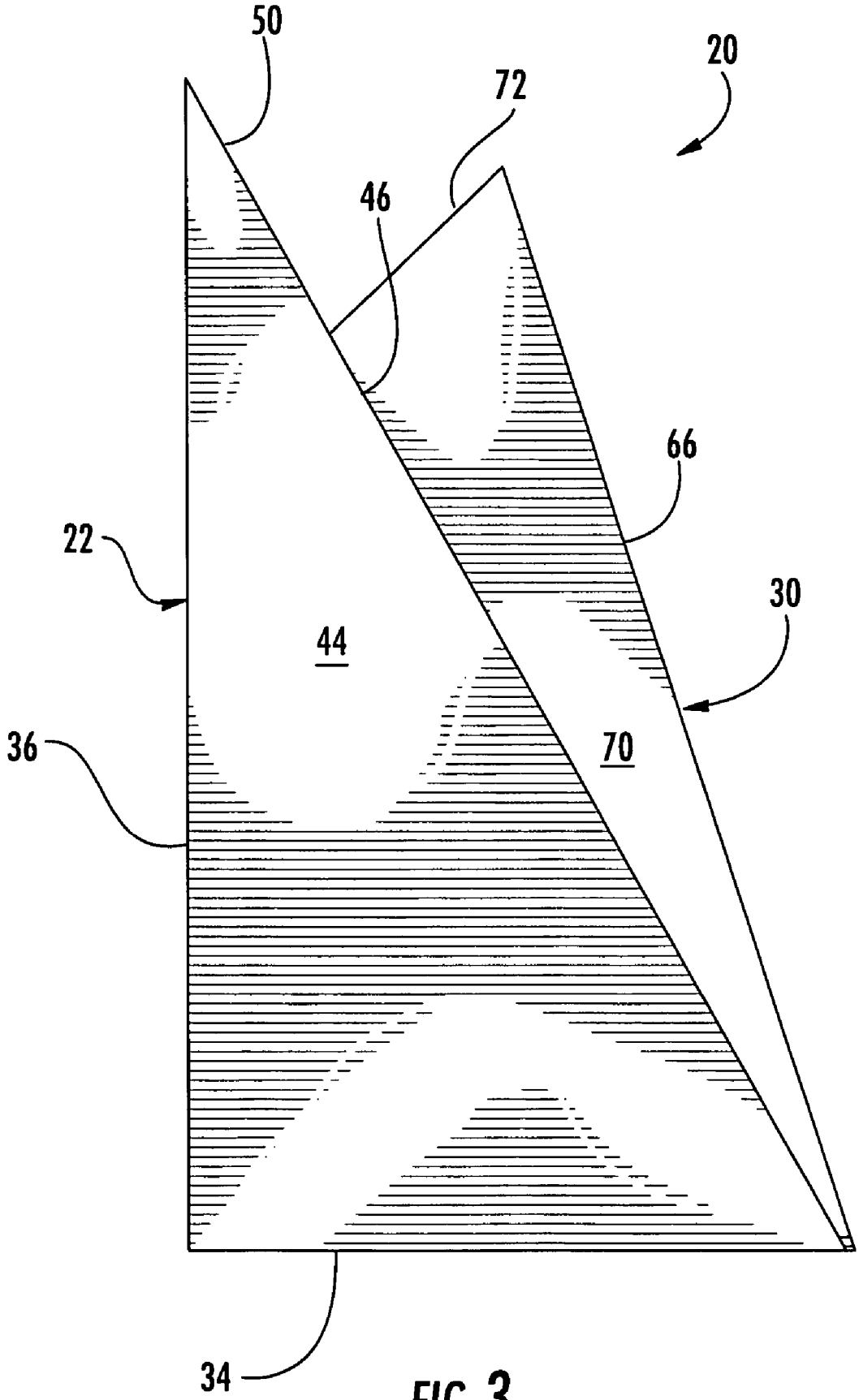
FIG. 3 is a left elevation view of the carton in the closed configuration, wherein a right elevation view of the carton in the closed configuration is a mirror image of FIG. 3.
Figure 4:
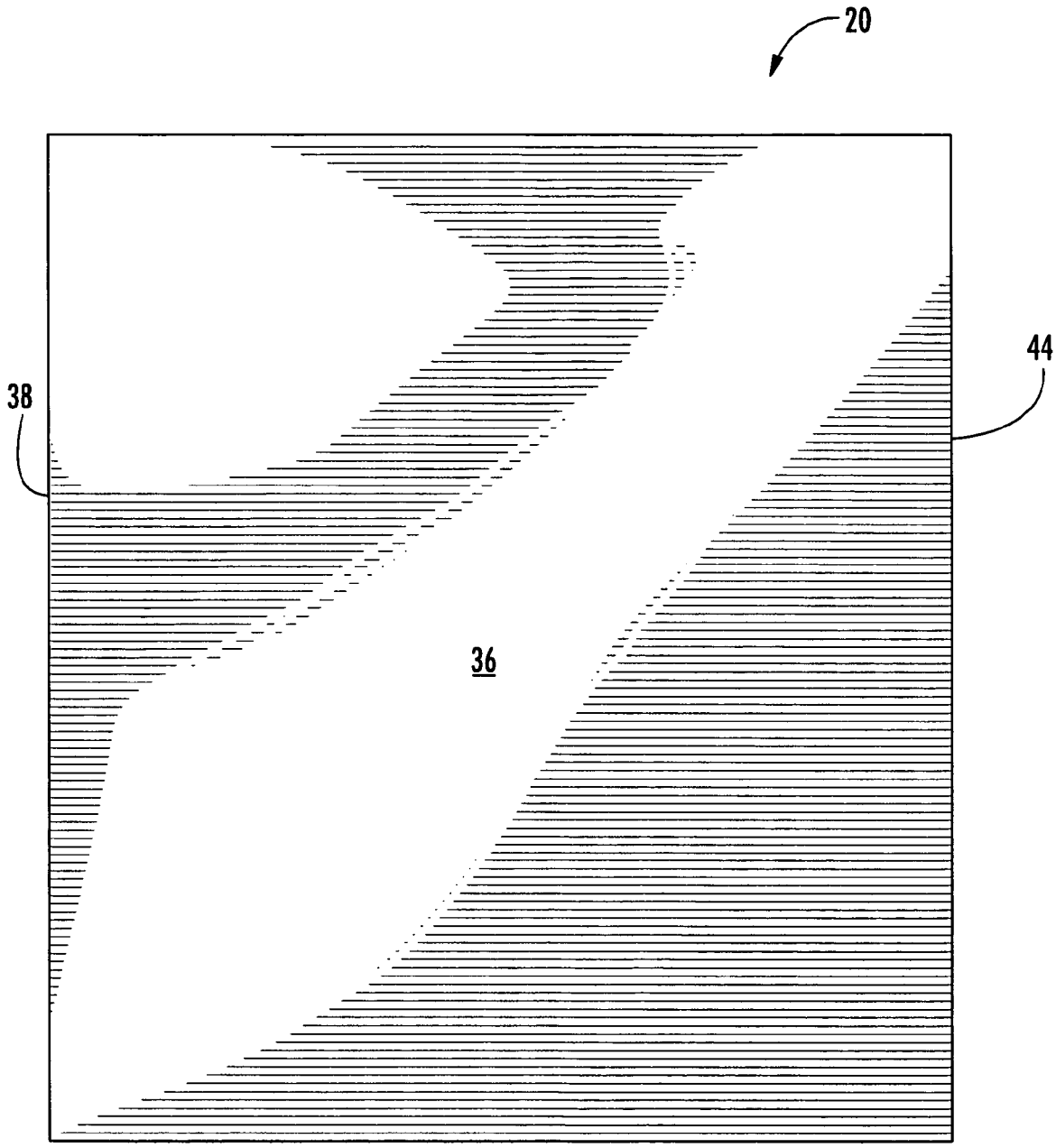
FIG. 4 is a rear elevation view of the carton in both the closed configuration and an open configuration of the carton, in according with the exemplary embodiment of the present invention.
Figure 5:
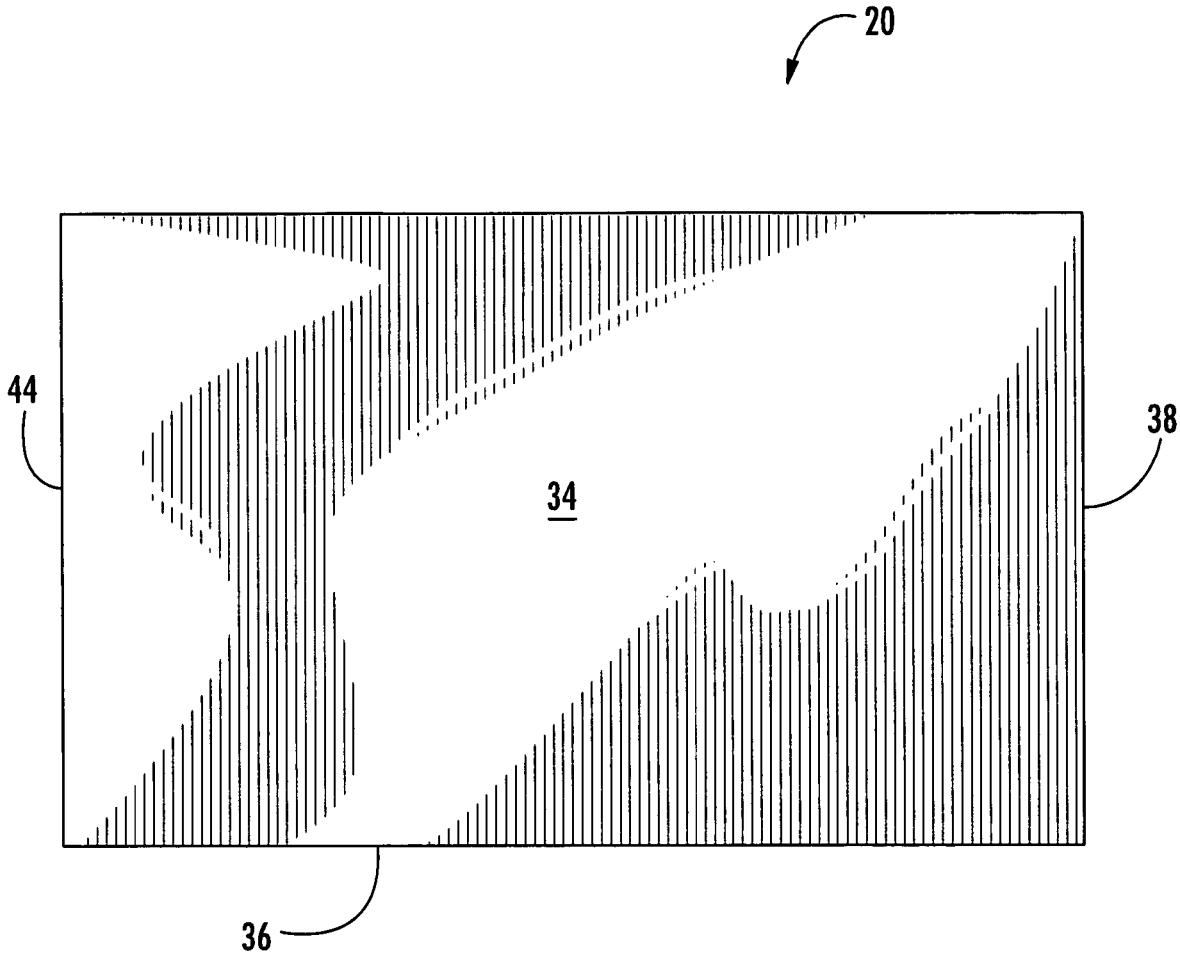
FIG. 5 is a bottom plan view of the carton in the closed configuration.
Figure 6:
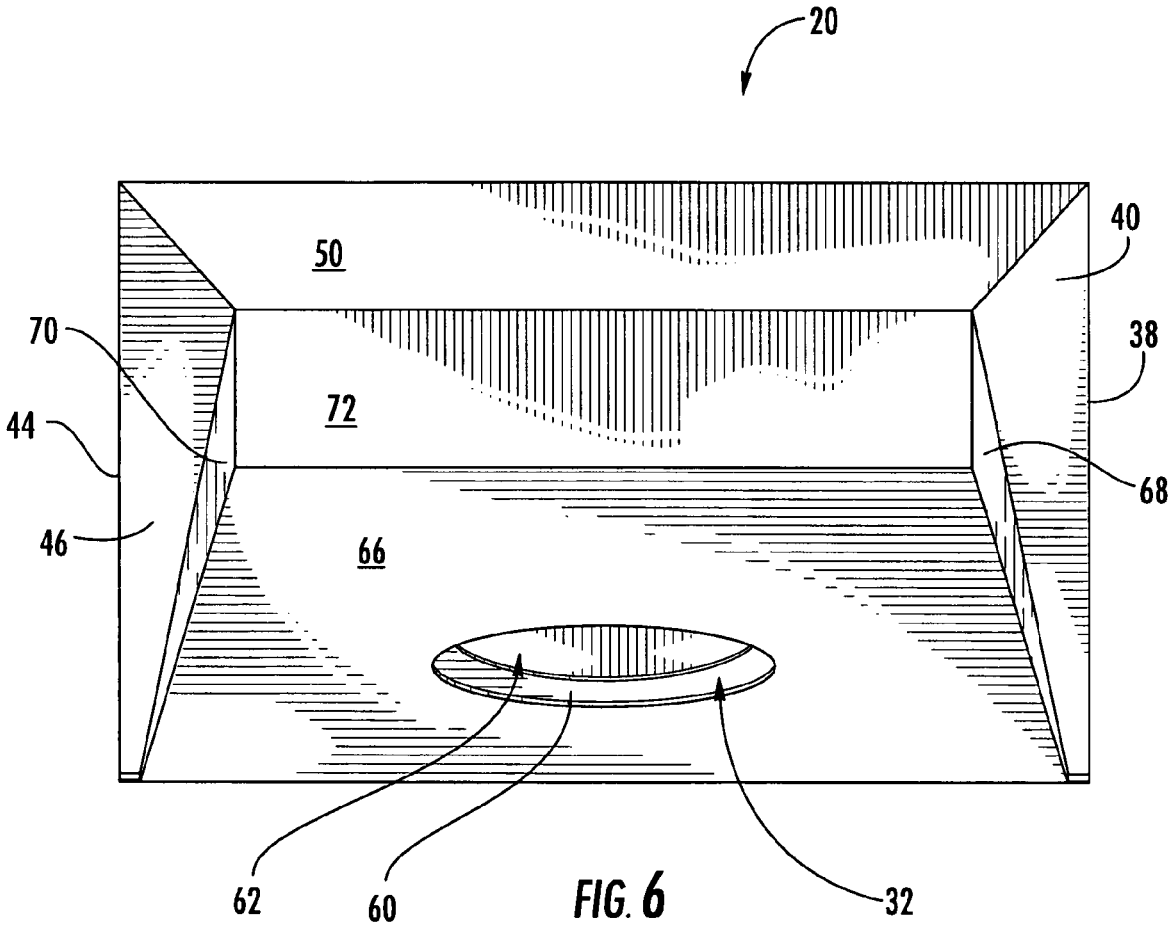
FIG. 6 is a top plan view of the carton in the closed configuration.
Figure 10:
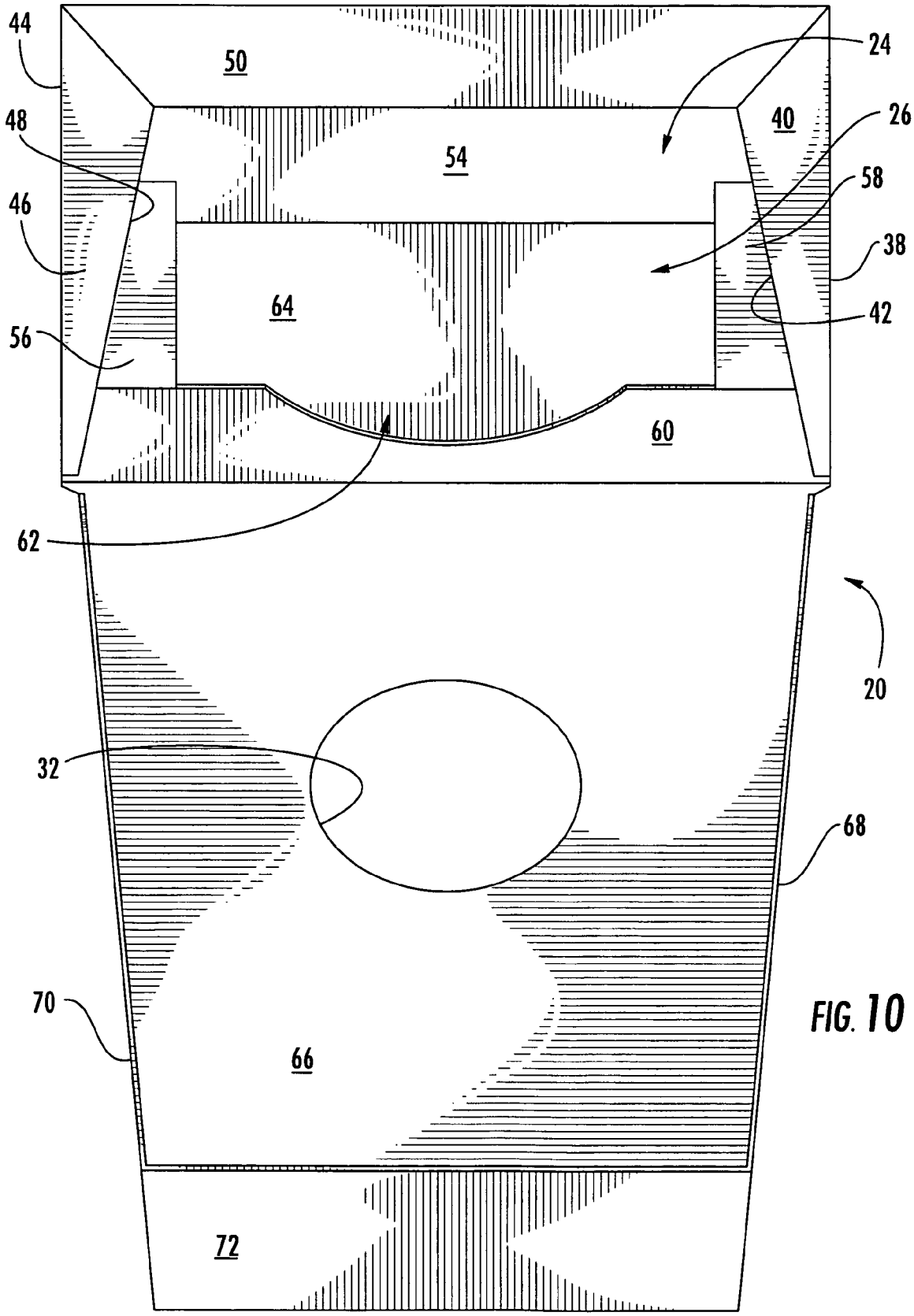
FIG. 10 is a top plan view of the carton in the open configuration.
Figure 11:
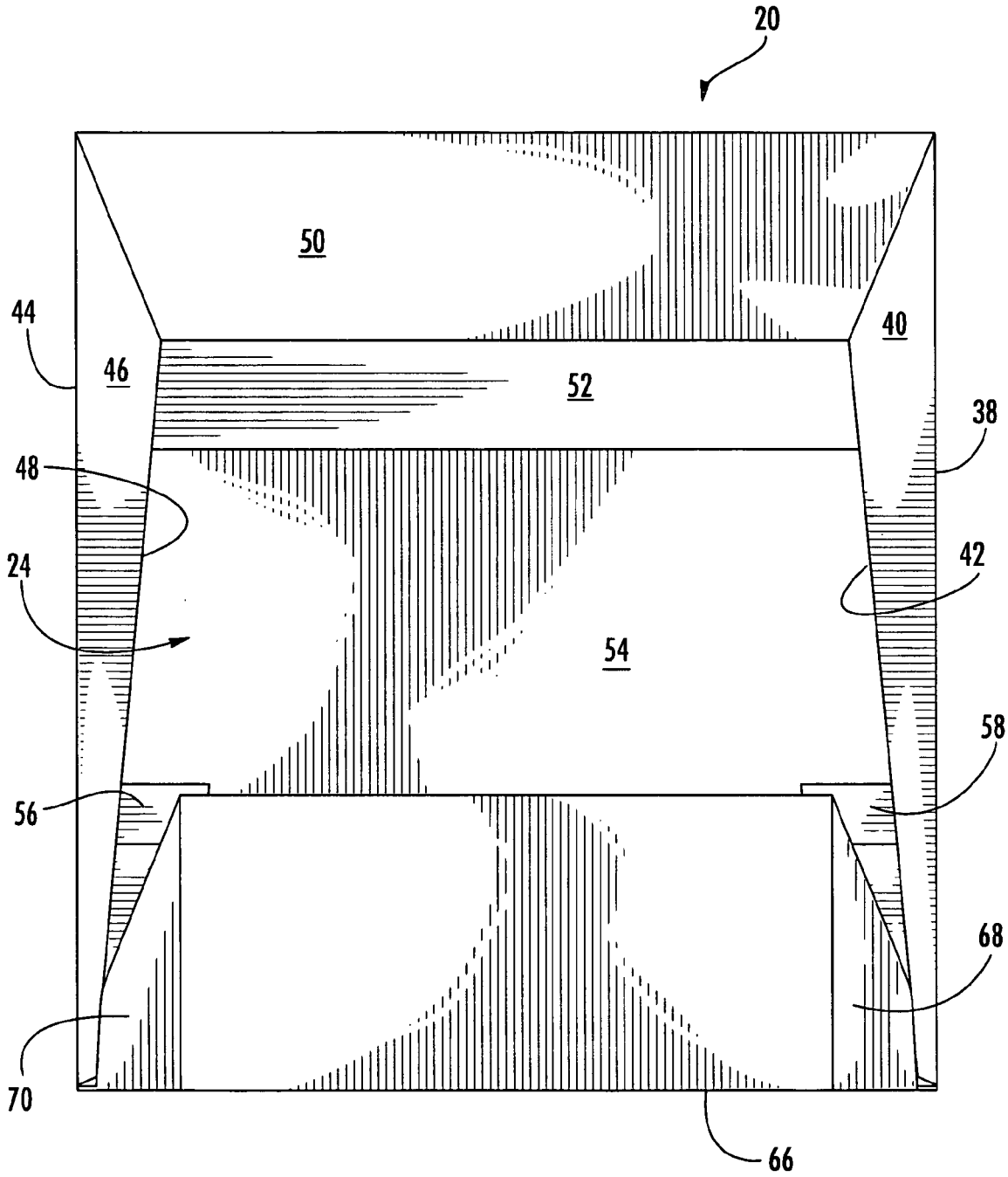
FIG. 11 is a front elevation view of the carton in the open configuration.

As can be understood with reference to FIG. 3, the container portion 22 includes an outer base panel 34 and an outer rear panel 36 that extends upwardly from a rear edge of the outer base panel. Referring for example to FIGS. 5, 7 and 10, an outer right side panel 38 is connected to the right edge of the outer rear panel 36 and extends forwardly therefrom. A right border panel 40 extends inwardly from a forward edge of the outer right side panel 38. An inner right side panel 42 (FIG. 11) extends rearwardly from an inner edge of the right border panel 42.

Figure 1:
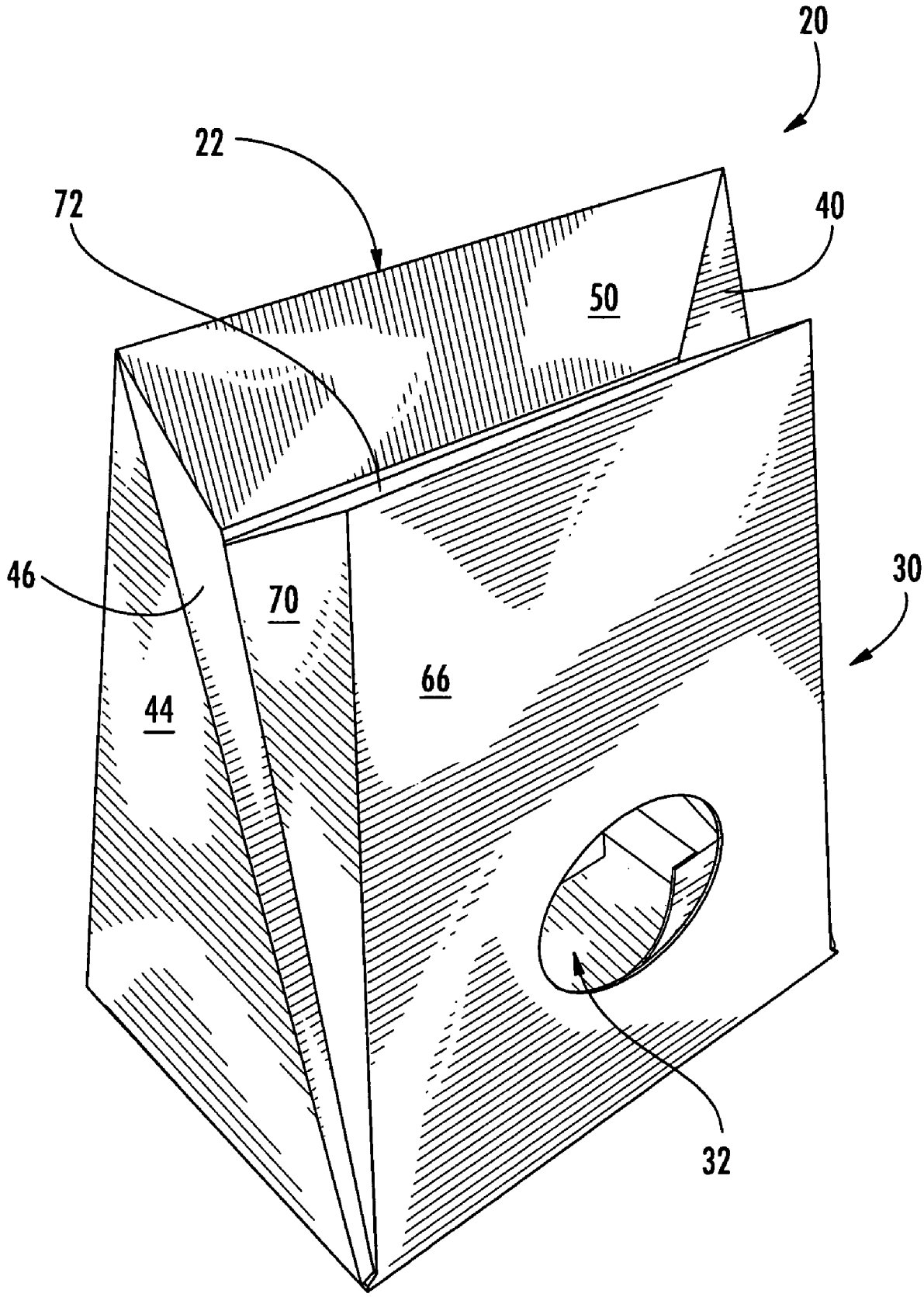
FIG. 1 is a left perspective view of a carton in a closed configuration, with a right perspective view of the carton in the closed configuration being a mirror image of FIG. 1, in according with an exemplary embodiment of the present invention.
Figure 2:
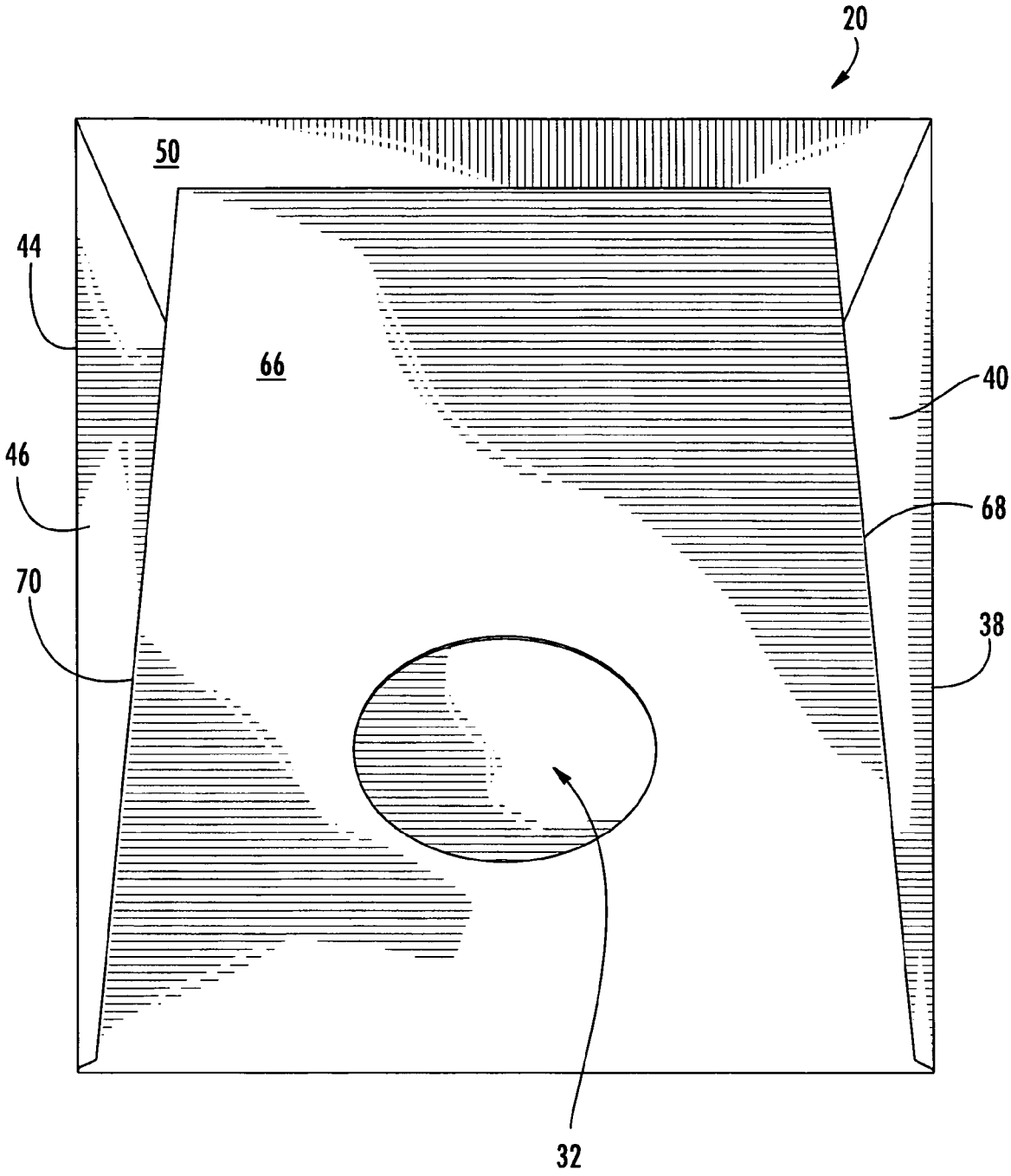
FIG. 2 is a front elevation view of the carton in the closed configuration.

Referring for example to FIGS. 1, 5, and 7, an outer left side panel 44 extends forwardly from a left edge of the outer rear panel 36. A left border panel 46 extends inwardly from a forward edge of the outer left side panel 44. An inner left side panel 48 extends inwardly from an inner edge of the left border panel 46. As best understood with reference to FIG. 7, each of the right and left border panels 40, 46 face generally forwardly, extend rearwardly and upwardly from proximate the forward edge of the outer base panel 34, and extend obliquely with respect to the outer base panel 34.

Referring for example to FIG. 3, an upper border panel 50 extends downwardly and forwardly from the upper edge of the outer rear panel 36, and obliquely with respect to the outer rear panel 36. In accordance with the exemplary embodiment of the present invention, all of the boarder panels 40, 46, 50 are coplanar with respect to one another.

Referring to FIG. 7, an inner upper panel 52 extends inwardly and rearwardly from the lower edge of the upper border panel 50. An inner rear panel 54 extends downwardly and forwardly from the lower edge of the inner upper panel 52. Spanning panels 56, 58 span between the inner rear panel 54 and respective upper edges of a front panel 60. As best understood with reference to FIG. 12, the front panel 60 can include a receptacle's viewing opening 62 for helping to provide a good view of the one or more articles 28 within the receptacle 26. Referring to FIG. 7, an inner bottom panel 64 extends rearwardly from the lower edge of the front panel 60.

As best understood with reference to FIG. 10, the cavity 24 is collectively defined by the inner right side panel 42, inner left side panel 48, inner upper panel 52 (FIG. 7), inner rear panel 54, front panel 60, and inner bottom panel 64. The receptacle 26 is defined by a lower portion of the inner rear panel 54, the span panels 56, 58, front panel 60 and inner bottom panel 64.

Referring for example to FIG. 7, the cover portion 30 includes a cover panel 66 that is pivotally connected to the forward edge of the outer base panel 34. A right side panel 68 is connected to the right edge of the cover panel 66, and extends perpendicularly to the cover panel. A left side panel 70 is connected to the left edge of the cover panel 66, and extends perpendicularly to the cover panel. An end panel 72 is connected to the end edge of the cover panel 66, and extends obliquely to the cover panel.

In the closed configuration that is illustrated for example in FIG. 1, the lower end of the right side panel 68 extends into a right slot. As best understood with reference to FIG. 10, the right slot is defined between the right edge of the front panel 60 and the inner right side panel 42. The right slot is further partially defined between the right edge of the right span panel 58 and the inner right side panel 42. In addition, the right side panel 68 is in an opposing face-to-face configuration with the inner right side panel 42 during the closed configuration.

Similarly, the lower end of the left side panel 70 is in a left slot during the closed configuration. The left slot is defined between the left edge of the front panel 60 and the inner left side panel 48. The left slot is also partially defined between the left edge of the left span panel 56 and the inner left side panel 48. The left side panel 70 is in opposing face-to-face configuration with respect to the inner left side panel 48 during the closed configuration. In addition, the end panel 72 is in opposing face-to-face configuration with respect to the inner upper panel 52 (FIG. 7) in the closed configuration. More specifically, each of the above-discussed opposing face-to-face configurations can be an opposing face-to-face contact.

As best understood with reference to FIG. 3, the upper border panel 50 and the end panel 72 can be characterized as being in opposing face-to-face configuration with respect to one another in the closed configuration, for example since the oblique angle defined between the border panel 50 and the end panel 72 is more specifically an acute angle.

Figure 13:
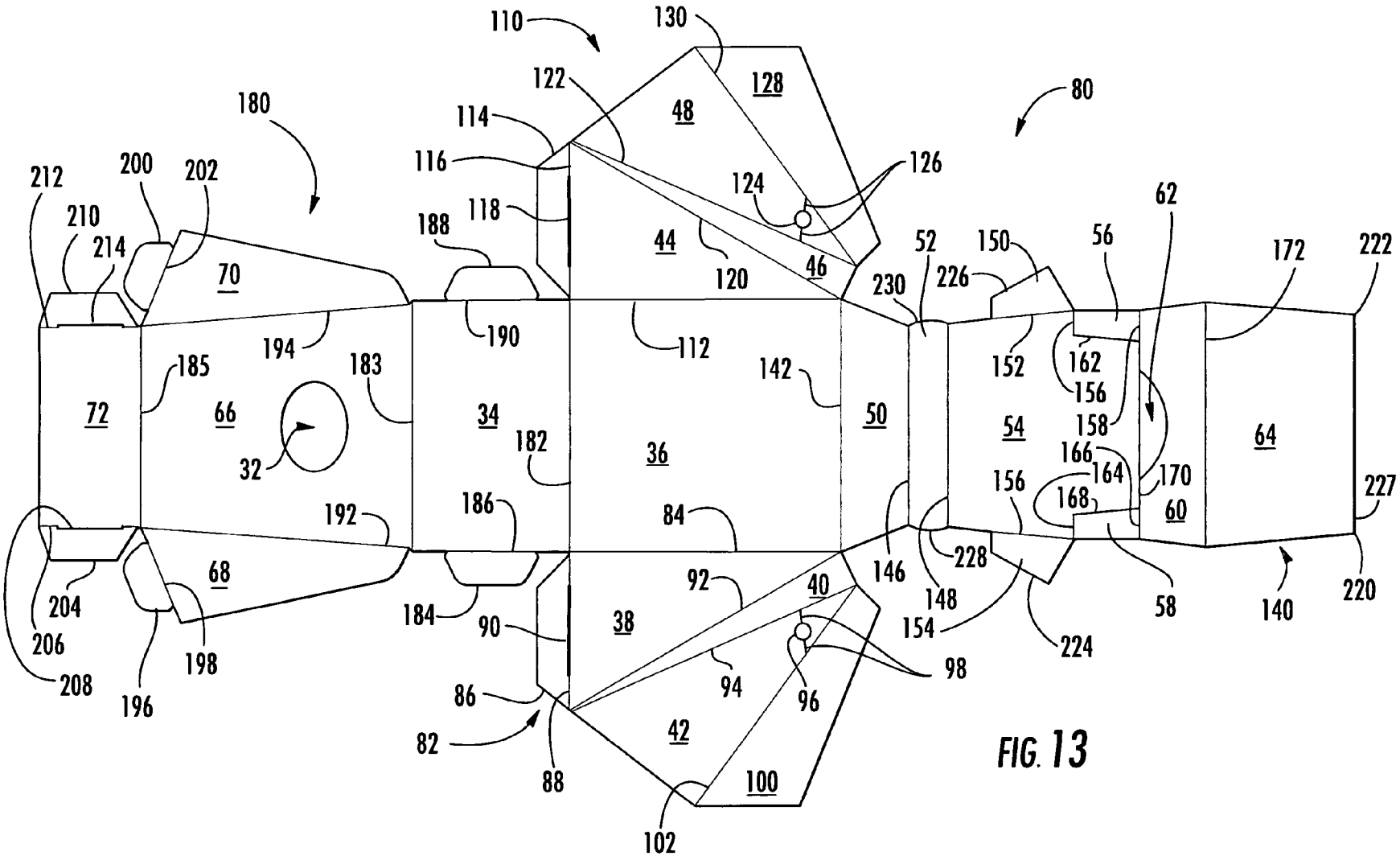
FIG. 13 is schematic plan view of a blank from which the carton can be formed, with the blank unerected and flat, in accordance with the exemplary embodiment of the present invention.

FIG. 13 illustrates a blank 80 from which the carton 20 can be erected, in accordance with the exemplary embodiment of the present invention. As mentioned previously, the outer rear panel 36 can also be referred to as a central panel 36. The blank 80 includes a first series of panels 82 that are connected along a longitudinal fold line 84 to the central panel 36. The first series of panels 82 includes the outer right side panel 38 connected to the central panel 36 along a longitudinal fold line 84, the right border panel 40 connected to the outer right side panel 38 along an oblique fold line 92, the inner right side panel 42 connected to the right border panel 40 along an oblique fold line 94, and an interior right side panel 100 connected to the inner right side panel 42 along an oblique fold line 102.

A fastening tab 86 is connected to the outer right side panel 38 along a lateral fold line 88. A lateral fastening slit 90 extends partially along the lateral fold line 88. The inner right side panel 42 includes a fastening opening 96 and fastening slits 98 that extend outwardly from the fastening opening 96. Each of the fastening opening 96 and the fastening slits 98 extend completely through the inner right side panel 42.

The blank 80 further includes a second series of panels 110 that is connected to an edge of the central panel 36 along a longitudinal fold line 112. The second series of panels 110 includes the outer left side panel 44 connected to the central panel 36 along the longitudinal fold line 112, the left border panel 46 connected to the outer left side panel 44 along an oblique fold line 120, the inner left side panel 48 connected to the left border panel 46 along an oblique fold line 122, and an interior left side panel 128 connected to the inner left side panel 48 along an oblique fold line 130.

A fastening tab 114 is connected to the outer left side panel 44 by a lateral fold line 116. A lateral fastening slit 118 extends along the lateral fold line 116. The inner left side panel 48 includes a fastening opening 124 and fastening slits 126 that extend outwardly from the fastening opening 124. Each of the fastening opening 124 and the fastening slits 126 extend completely through the inner left side panel 48.

The blank 80 further includes a third series of panels 140 connected to an edge of the central panel 36 by a lateral fold line 142. The third series of panels 140 includes the upper border panel 50 connected to the central panel 36 by the lateral fold line 142, the inner upper panel 52 connected to the upper border panel 50 by a lateral fold line 146, the inner rear panel 54 connected to the inner upper panel 52 by a lateral fold line 148, the spanning panels 56, 58 respectively connected to the inner rear panel 54 by lateral fold lines 156 and 164, the front panel 60 respectively connected to the spanning panels 56, 58 along lateral fold lines 158 and 166, and the inner bottom panel 64 connected to the front panel 60 by a lateral fold line 172.

A bracing tab 154 is connected to the inner rear panel 54 by a fold line 156. A bracing tab 150 is connected to the inner rear panel 54 by a fold line 152. A slit 162 extends between an end of lateral fold line 156 and an end of lateral fold line 158. Similarly, a slit 168 extends between an end of lateral fold line 164 and an end of lateral fold line 166. A slit 170 extends between an end of lateral fold line 158 and an end of lateral fold line 166 so that the front panel 60 is not directly connected to the inner rear panel 54. The receptacle's viewing opening 62 extends completely through the front panel 60.

The blank 80 further includes a fourth series of panels 180 connected to an edge of the central panel 36 by a lateral fold line 182. The fourth series of panels 180 includes the outer base panel 34 connected to the central panel 36 by a lateral fold line 182, the cover panel 66 connected to the outer base panel 34 by a lateral fold line 183, and the end panel 72 connected to the cover panel 66 by a lateral fold line 185.

A fastening tab 184 is connected to the outer base panel 34 by a longitudinal fold line 186. A fastening tab 188 is connected to the outer base panel 34 by a longitudinal fold line 190. The right side panel 68 is connected to the cover panel 66 by an oblique fold line 192. The left side panel 70 is connected to the cover panel 66 by an oblique fold line 194. A fastening tab 196 is connected to the right side panel 68 by an oblique fold line 198. A fastening tab 200 is connected to left side panel 70 by an oblique fold line 202. A fastening tab 204 is connected to the end panel 72 by a longitudinal fold line 206. A longitudinal fastening slot 208 extends along the longitudinal fold line 206. A fastening tab 210 is connected to the end panel 72 by a longitudinal fold line 212. A longitudinal fastening slot 214 extends along the longitudinal fold line 212. The cover's viewing opening 32 extends completely through the cover panel 66.

As best understood with reference to FIG. 13, the third and fourth series of panels 140, 180 are aligned with one another. In addition, the first and second series of panels 82, 110 reach toward the third plurality of panels 140.

Figure 14:
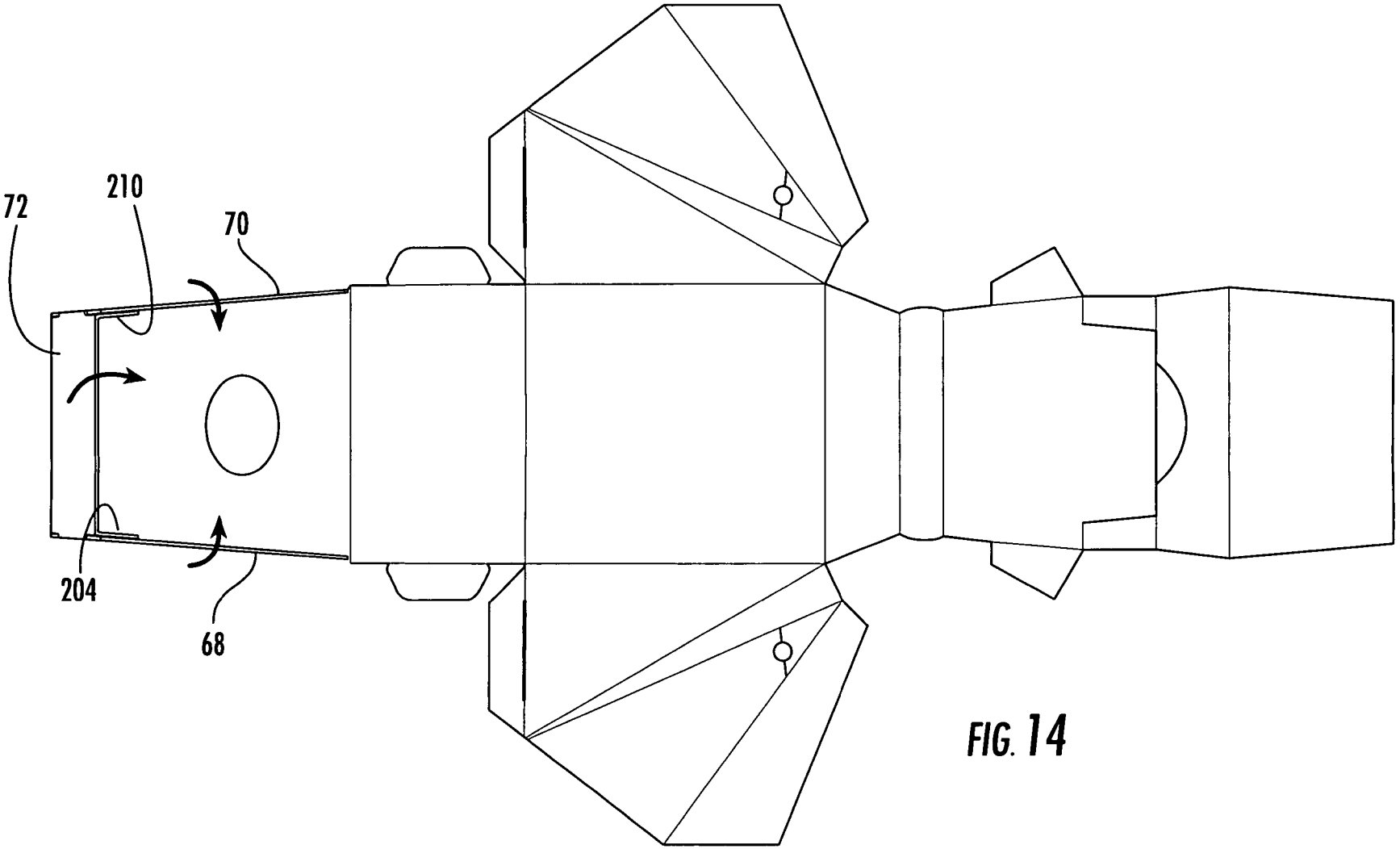
FIG. 14 schematically illustrates a step in erecting the carton from the blank, in accordance with the exemplary embodiment of the present invention.

A method for forming the carton 20 from blank 80 will be described in the following, in accordance with the exemplary embodiment of the present invention. As best understood with reference to FIG. 14, the end panel 72 and fastening tabs 204 and 210 can be folded inwardly. Thereafter, the right side panel 68 and left side panel 70 can be folded inwardly. Then, fastening tabs 196 and 210 (FIG. 13) can be folded and respectively inserted into longitudinal fastening slots 208 and 214 (FIG. 13).

Figure 15:
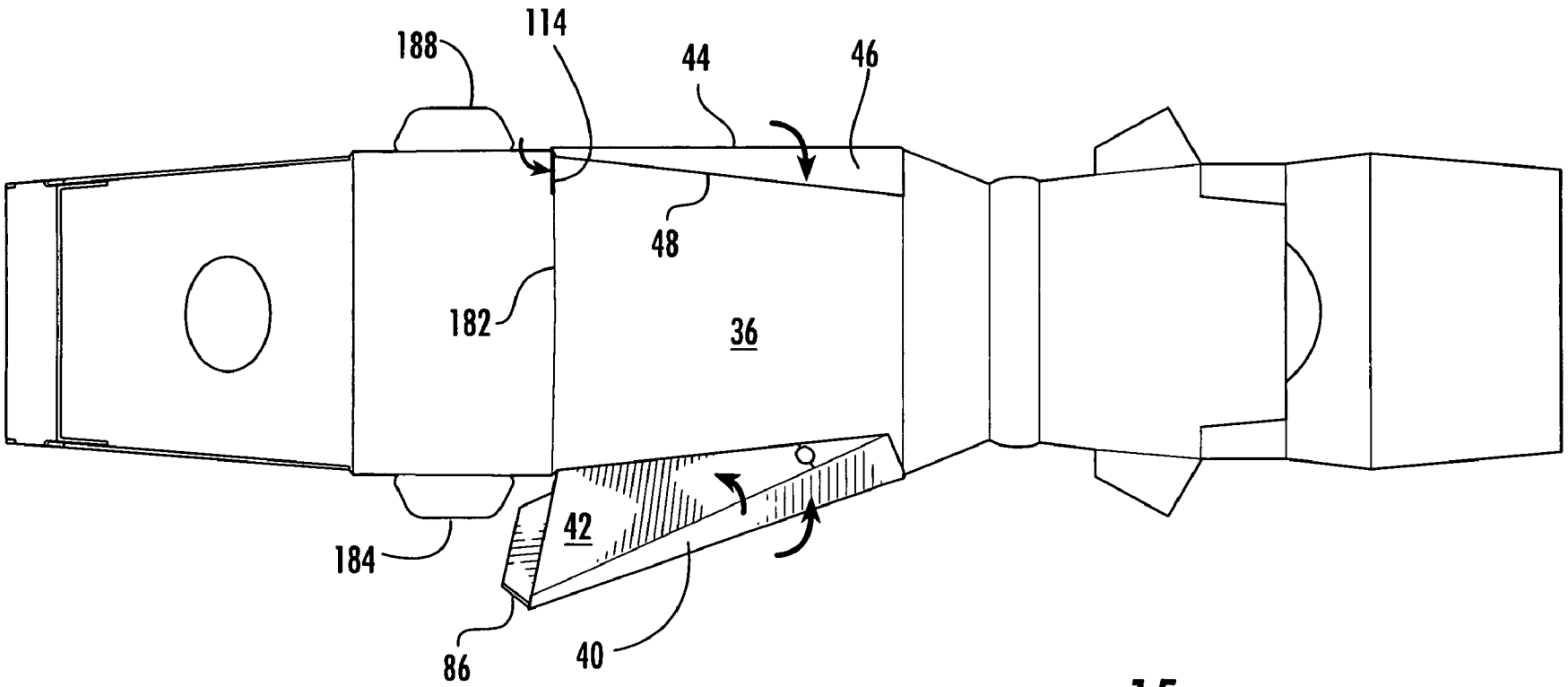
FIG. 15 schematically illustrates a step in erecting the carton from the blank, in accordance with the exemplary embodiment of the present invention.

Referring to FIGS. 13 and 15, the first series of panels 82 can be respectively folded along fold lines 84, 92, 94, and 102 so that the interior right side panel 100 is positioned between the outer right side panel 38 and inner right side panel 42, and the outer right side panel 38 extends perpendicularly from the central panel 36. Then, the fastening tab 86 is folded inwardly. Similarly, the second series of panels 110 is respectively folded along fold lines 112, 120, 122, and 130 so that the interior left side panel 128 is between the outer left side panel 44 and inner left side panel 48, and the outer left side panel 44 extends perpendicularly from the central panel 36. Then, the fastening tab 114 is folded inwardly.

Figure 16:
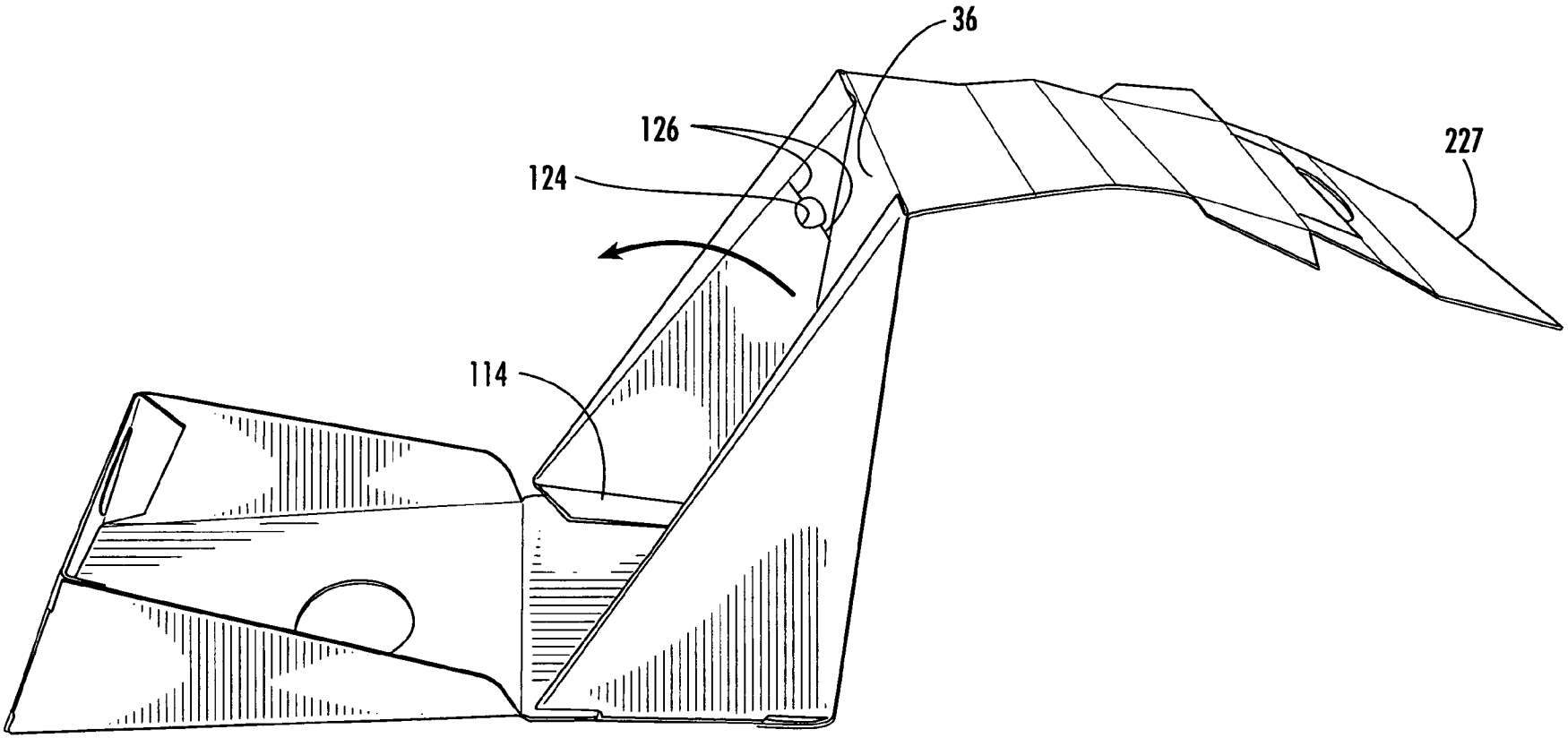
FIG. 16 schematically illustrates a step in erecting the carton from the blank, in accordance with the exemplary embodiment of the present invention.

Thereafter, and as best understood with reference to FIGS. 13 and 16, folding can occur along lateral fold line 182, and fastening tabs 184 and 188 are folded inwardly and respectively received in fastening slits 90 and 118.

Figure 17:
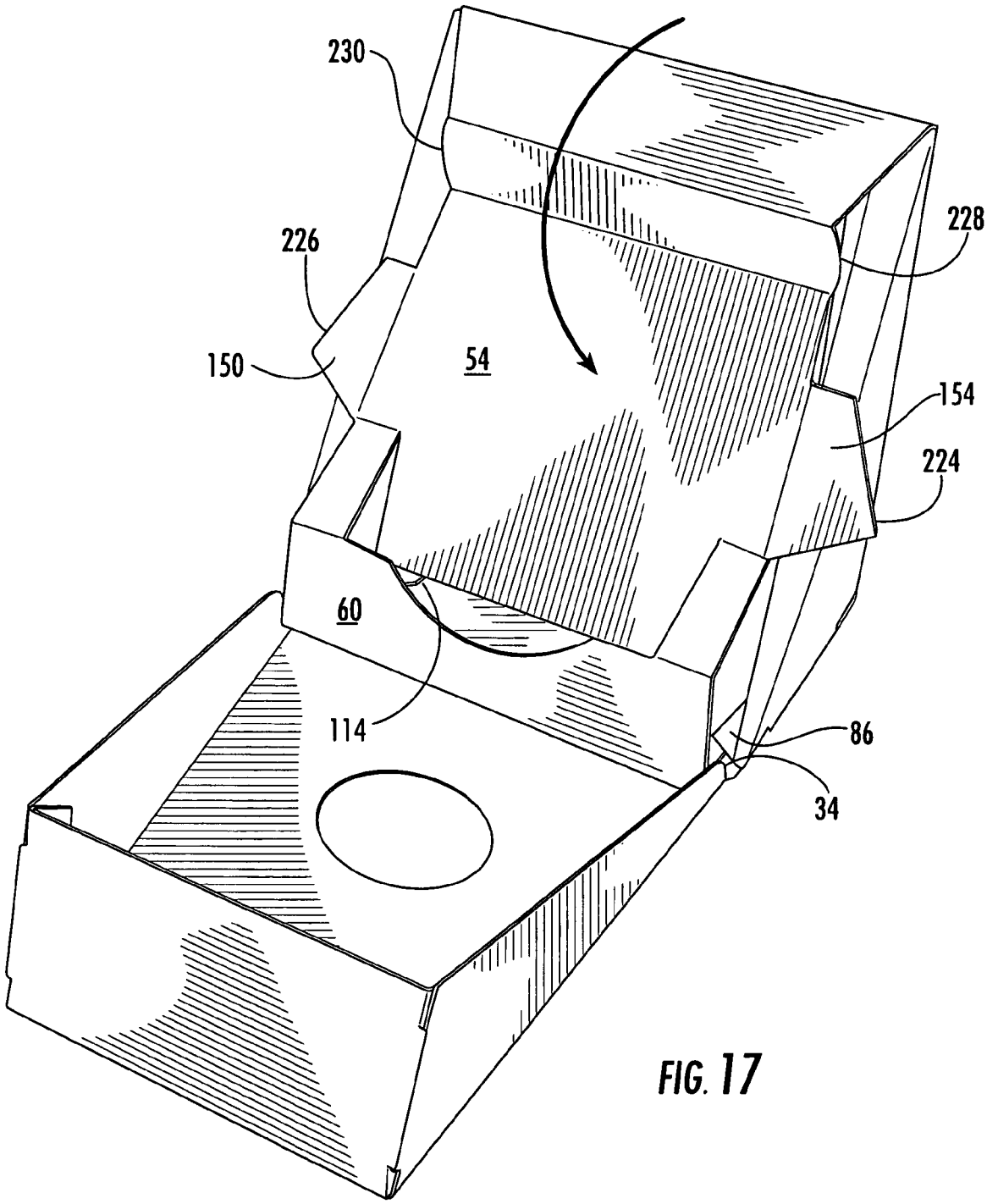
FIG. 17 schematically illustrates a step in erecting the carton from the blank, in accordance with the exemplary embodiment of the present invention.

Referring to FIGS. 13 and 17, thereafter, folding occurs all along the remaining fold lines of the third series of panels 140. A right corner 220 (FIG. 13) of the inner bottom panel 64 is introduced into a slot defined between the fastening tab 86 and the outer base panel 34. Simultaneously or at about the same time, a left corner 220 (FIG. 13) of the inner bottom panel 64 is introduced into a slot defined between the fastening tab 114 and the outer base panel 34.

The bracing tabs 150, 154 are folded rearwardly with respect to inner rear panel 54 and inserted into the partially formed cavity 24 (FIG. 7) so that the bracing tabs 150, 154 are respectively in opposing face-to-face configuration with respect to the inner right side panel 42 and the inner left side panel 48. More specifically, these opposing face-to-face configurations can be opposing face-to-face contacts. Thereafter, the inner rear panel 54 and the front panel 60 are pushed rearwardly until abutment edges 224, 226 of the bracing tabs 154, 150 abut the interior surface of the outer rear panel 36, and a rear edge 227 (FIG. 13) of the inner bottom panel 64 also abuts the interior surface of the outer rear panel 36. At about the same time, right and left edges 228, 230 of the inner upper panel 52 respectively snap into the fastening openings 96, 124 (FIGS. 13 and 16).

In accordance with the exemplary embodiment of the present invention, a fold line can be any at least somewhat line-like arranged, although not necessarily straight, form of weakening that facilitates folding therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. In situations where cutting is used to provide a fold line, typically the cutting will not be overly extensive in a manner that might cause a reasonable user to incorrectly consider the fold line to be a tear line.

In accordance with the exemplary embodiment of the present invention, the blank is constructed of paperboard, or the like, and the paperboard can optionally have one or more other materials coated or laminated thereon. For example, paperboard typically weighs at least about 100 pounds per ream, with each sheet of paperboard typically being at least about 0.012 inches thick, so that it is heavier and more rigid than ordinary paper. The blank can also be constructed of other material, such as cardboard, or any other material having properties suitable for enabling the carton to function at least generally as described above.

For example, one or both sides of the blank can be coated with a clay coating, or the like. The clay coating can be printed over with product, advertising, and other information or images. The blank may then be coated with a varnish or other protective coating to protect any information printed on the blank. The blank may also be coated with, for example, a moisture barrier layer, on either or both sides of the blank. Other coating and laminating upon the blank is also within the scope of the present invention.

The directional references, for example "top", "front", "left", "longitudinal" and "forwardly", referred to in this Detailed Description section are used for ease of understanding rather than for the purpose of narrowing the scope of the present invention.

It will be understood by those skilled in the art that while the present invention has been discussed above with reference to an exemplary embodiment, various additions, modifications and changes can be made thereto without departing from the spirit and scope of the invention as set forth in the following claims.

What is claimed is:

1. A carton capable of containing at least one article, the carton comprising:

a container portion defining a cavity for at least partially containing the article, wherein the container portion includes (a) first and second border panels that are respectively positioned proximate opposite first and second sides of an opening to the cavity, wherein each of the first and second border panels faces at least generally in a first direction that is away from the cavity, so that both the first boarder panel and the second border panel face at least generally in the first direction, away from the cavity, and wherein the first direction is at least generally forwardly, and each of the first and second border panels includes opposite outer and inner edges, (b) a first outer side panel connected to the outer edge of the first boarder panel, wherein the first outer side panel extends at least generally in a second direction, and the second direction is opposite from the first direction, (c) a first inner side panel connected to the inner edge of the first boarder panel, wherein the first inner side panel extends at least generally in the second direction, (d) a second outer side panel connected to the outer edge of the second boarder panel, wherein the second outer side panel extends at least generally in the second direction, (e) a second inner side panel connected to the inner edge of the second boarder panel, wherein the second inner side panel extends at least generally in the second directions (f) a third border panel positioned proximate a third side of the opening to the cavity, wherein the third border panel extends from proximate an end of the first border panel to proximate an end of the second border panel, and the third border panel faces at least generally in the first direction that is away from the cavity, and (g) a base panel and a rear panel that extends upwardly from a rearward end of the base panel, wherein (1) each of the first and second border panels extends upwardly and rearwardly from proximate a forward end of the base panel, and obliquely with respect to the base panel, and (2) the third border panel extends downwardly and forwardly from an upper end of the rear panel, and obliquely with respect to the rear panel; and a cover portion movable between closed and opened configurations, and including a cover panel that at least partially closes the opening to the cavity in the closed configuration, wherein at least a portion of the cover panel is farther away from the cavity in the opened configuration than in the closed configuration, so that the opening to the cavity is at least partially open in the opened configuration, the cover panel includes opposite inner and outer sides, the inner side of the cover panel faces toward the cavity while the cover portion is in the closed configuration, the outer side of the cover panel faces at least generally in the first direction that is away from the cavity while the cover portion is in the closed configuration, and the cover portion at least partially fits between the border panels while the cover portion is in the closed configuration.

2. The carton according to claim 1, wherein the cover panel defines an opening that extends through the cover panel for providing at least visual access to the cavity while the cover portion is in the closed configuration.

3. The carton according to claim 1, wherein the cover portion is pivotably connected to a forward end of the base panel.

4. The carton according to claim 1, wherein the container portion further includes an upwardly open receptacle that is adjacent the base panel for holding at least the article in the cavity.

5. The carton according to claim 1, wherein each of the first and second border panels extends obliquely with respect to the cover panel while the cover portion is in the closed configuration.

6. The carton according to claim 1, wherein the first, second and third border panels are at least substantially coplanar with respect to one another.

7. The carton according to claim 1, wherein:

the cover panel includes opposite first and second edges;

the cover portion further includes (a) a first side panel connected to the first edge of the cover panel, and (b) a second side panel connected to the second edge of the cover panel; and in the closed configuration of the cover portion, (a) the first side panel of the cover portion is in opposing face-to-face relation with the first inner side panel of the container portion, and (b) the second side panel of the cover portion is in opposing face-to-face relation with the second inner side panel of the container portion.

8. The carton according to claim 1, wherein:

the first direction is forward;

the second direction is rearward;

each of the first and second border panels faces forwardly;

the first outer side panel extends rearwardly from the outer edge of the first boarder panel;

the first inner side panel extends rearwardly from the inner edge of the first boarder panel;

the second outer side panel extends rearwardly from the outer edge of the second boarder panel; and the second inner side panel extends rearwardly from the inner edge of the second boarder panel.

9. The carton according to claim 8, wherein each of the first and second border panels simultaneously faces forwardly and upwardly while a base of the carton extends horizontally, so that each of the first and second border panels extends obliquely with respect to the base.

10. A carton capable of containing at least one article, the carton comprising:

a container portion defining a cavity for at least partially containing the article, wherein the container portion includes (a) first and second border panels that are respectively positioned proximate opposite first and second sides of an opening to the cavity, wherein each of the first and second border panels faces at least generally in a first direction that is away from the cavity, so that both the first boarder panel and the second border panel face at least generally in the first direction, away from the cavity, and wherein each of the first and second border panels includes opposite outer and inner edges, (b) a first outer side panel connected to the outer edge of the first boarder panel, wherein the first outer side panel extends at least generally in a second direction, and the second direction is opposite from the first direction, (c) a first inner side panel connected to the inner edge of the first boarder panel, wherein the first inner side panel extends at least generally in the second direction, (d) a second outer side panel connected to the outer edge of the second boarder panel, wherein the second outer side panel extends at least generally in the second direction, (e) a second inner side panel connected to the inner edge of the second boarder panel, wherein the second inner side panel extends at least generally in the second direction, (f) a base panel, (g) a rear panel that extends upwardly from a rearward end of the base panel, and (h) an upper panel, wherein the upper panel extends downwardly and forwardly from the upper end of the rear panel, and obliquely with respect to the rear panel, so that the container portion defines an upwardly pointing top; and a cover portion movable between closed and opened configurations, and including a cover panel that at least partially closes the opening to the cavity in the closed configuration, wherein at least a portion of the cover panel is farther away from the cavity in the opened configuration than in the closed configuration, so that the opening to the cavity is at least partially open in the opened configuration, the cover panel includes opposite inner and outer sides, the inner side of the cover panel faces toward the cavity while the cover portion is in the closed configuration, the outer side of the cover panel faces at least generally in the first direction that is away from the cavity while the cover portion is in the closed configuration, the cover portion at least partially fits between the border panels while the cover portion is in the closed configuration, the cover portion further includes an end panel, wherein the end panel extends downwardly and rearwardly from an end of the cover panel, and obliquely with respect to the cover panel, while the cover portion is in the closed configuration, so that the cover portion defines an upwardly pointing top while the cover portion is in the closed configuration, and in a side view of the carton in the closed configuration, the upper panel of the container portion and the end panel of the cover portion extend downwardly convergently toward one another so that a recess is defined between the top of the container portion and the top of the cover portion.

11. The carton according to claim 10, wherein the recess defined between the top of the container portion and the top of the cover portion is at least generally v-shaped.

12. A carton capable of containing at least one article, the carton comprising:

a base panel;

a rear panel extending upwardly from a rear edge of the base panel;

a right side panel extending forwardly from a right side edge of the rear panel;

a left side panel extending forwardly from a left side edge of the rear panel;

a cavity at least partially positioned between the right and left side panels for at least partially containing the article; and a plurality of panels that are respectively foldably connected to one another in series, wherein the plurality of panels is connected to an upper edge of the rear panel, and the plurality of panels includes (a) an at least generally forwardly facing upper panel that extends downwardly and forwardly away from the upper edge of the rear panel, and obliquely with respect to the rear panel, (b) a first panel that is foldably connected to a lower edge of the upper panel, and (c) an inner bottom panel that is superposed with the base panel.

13. The carton according to claim 12, further comprising:

a cover panel connected to a forward edge of the base panel for pivoting at least between closed and opened configurations, wherein the cover panel at least partially closes an opening to the cavity in the closed configuration, and at least a portion of the cover panel is farther away from the cavity in the opened configuration than in the closed configuration, so that the opening to the cavity is at least partially open in the opened configuration; and an end panel connected to an end of the cover panel that is opposite from the forward edge of the base panel, wherein the end panel extends downwardly and rearwardly from the end of the cover panel, and obliquely with respect to the cover panel, during the closed configuration, and the end panel and the upper panel are in opposing face-to-face configuration with respect to one another during the closed configuration.

14. The carton according to claim 13, wherein the cover panel defines an opening that extends through the cover panel for providing at least visual access to the cavity during the closed configuration.

15. The carton according to claim 13, wherein the end panel and the upper panel extend obliquely with respect to one another during the closed configuration.

16. The carton according to claim 12, further comprising:

an at least generally forwardly facing right border panel extending inwardly from a forward edge of the right side panel; and an at least generally forwardly facing left border panel extending inwardly from a forward edge of the left side panel.

17. The carton according to claim 16, wherein the right side panel comprises an outer right side panel, the left side panel comprises an outer left side panel, and the carton further comprises:

an inner right side panel extending rearwardly from an inner edge of the right border panel; and an inner left side panel extending rearwardly from an inner edge of the left border panel, wherein the inner right side panel and the inner left side panel at least partially define the cavity.

18. The carton according to claim 17, further comprising:

a cover panel connected to a forward edge of the base panel for pivoting at least between closed and opened configurations, wherein the cover panel at least partially closes an opening to the cavity in the closed configuration, and at least a portion of the cover panel is farther away from the cavity in the opened configuration than in the closed configuration, so that the opening to the cavity is at least partially open in the opened configuration;

a third right side panel connected to a right edge of the cover panel; and a third left side panel connected to a left edge of the cover panel, wherein the third right side panel and the inner right side panel are in an opposing face-to-face configuration with respect to one another during the closed configuration, and the third left side panel and the inner left side panel are in an opposing face-to-face configuration with respect to one another during the closed configuration.

19. The carton according to claim 16, wherein each of the right and left border panels extends obliquely with respect to each of the rear and base panels.

20. The carton according to claim 19, wherein the upper panel, the right border panel and the left border panel are at least substantially coplanar with respect to one another.

21. The carton according to claim 12, wherein:

the rear panel is an outer rear panel;

the first panel is an inner upper panel that is connected to the upper border panel by a lateral fold line;

the plurality of panels includes (a) an inner rear panel connected to the inner upper panel by a lateral fold line, (b) spanning panels respectively connected to the inner rear panel by lateral fold lines, and (c) a front panel respectively connected to the spanning panels along lateral fold lines; and the inner bottom panel is connected to a lower edge of the front panel by a lateral fold line.

22. The carton according to claim 21, wherein:

the inner rear panel extends upwardly;

the front panel extends upwardly and is spaced apart from the inner rear panel, so that a portion of the cavity is positioned between the front panel and the inner rear panel;

the spanning panels are laterally spaced apart from one another so that a portion of the cavity is positioned between the spanning panels; and the spanning panels (a) extend above the base panel, (b) are spaced apart from the base panel, (c) are superposed with the base panel, (d) extend forwardly from the inner rear panel, and (e) extend rearwardly from the front panel.

23. The carton according to claim 12, wherein:

the right side panel is a right outer side panel;

the left side panel is a left outer side panel; and the carton further comprises (a) a forwardly and upwardly facing right border panel extending inwardly from a forward edge of the right outer side panel, wherein the right border panel includes opposite outer and inner edges, and the right outer side panel extends rearwardly from the outer edge of the right boarder panel, (b) a forwardly and upwardly facing left border panel extending inwardly from a forward edge of the left outer side panel, wherein the left border panel includes opposite outer and inner edges, and the left outer side panel extends rearwardly from the outer edge of the left boarder panel, (c) a right inner side panel connected to, and extending rearwardly from, the inner edge of the right boarder panel, and (d) a left inner side panel connected to, and extending rearwardly from, the inner edge of the left boarder panel.

24. A blank for forming a carton, the blank comprising:

a central panel having (a) opposite first and second edges, and (b) opposite third and fourth edges;

a first plurality of panels that are arranged in series with respect to one another and are respectively foldably connected to one another by a first plurality of fold lines, wherein (a) each panel of the first plurality of panels includes opposite first and second edges, (b) the first edge of a first panel of the first plurality of panels is foldably connected to the first edge of the central panel, (c) the second edge of the first panel is connected at a first fold line of the first plurality of fold lines to the first edge of a second panel of the first plurality of panels, (d) the second edge of the second panel is connected at a second fold line of the first plurality of fold lines to the first edge of a third panel of the first plurality of panels, (e) the second edge of the third panel is connected at a third fold line of the first plurality of fold lines to the first edge of a fourth panel of the first plurality of panels, and (f) fold lines of the first plurality of fold lines extend obliquely with respect to the first edge of the central panel;

a second plurality of panels that are arranged in series with respect to one another and are respectively foldably connected to one another by a second plurality of fold lines, wherein a first panel of the second plurality of panels is foldably connected to the second edge of the central panel, and fold lines of the second plurality of fold lines extend obliquely with respect to the second edge of the central panel;

a third plurality of panels that are arranged in series with respect to one another and are respectively foldably connected to one another by a third plurality of fold lines, wherein a first panel of the third plurality of panels is foldably connected to the third edge of the central panel; and a fourth plurality of panels that are arranged in series with respect to one another and are respectively foldably connected to one another by a fourth plurality of fold lines, wherein a first panel of the fourth plurality of panels is foldably connected to the fourth edge of the central panel.

25. The blank according to claim 24, wherein:

the fold lines of the first plurality of fold lines extend obliquely with respect to one another; and the fold lines of the second plurality of fold lines extend obliquely with respect to one another.

26. The blank according to claim 24, wherein:

a panel of the third plurality of panels includes an opening extending therethrough;

a panel of the fourth plurality of panels includes an opening extending therethrough; and the opening in the panel of the third plurality of panels is for being at least generally aligned with the opening in the panel of the fourth plurality of panels in the carton formed from the blank.

27. The blank according to claim 26, wherein:

the panel of the third plurality of panels is fourth from the central panel in the third plurality of panels; and the panel of the fourth plurality of panels is second from the central panel in the fourth plurality of panels.

28. The blank according to claim 26, wherein each of the first and second plurality of panels reach toward the third plurality of panels while the blank is unerected and flat.

29. The blank according to claim 26, wherein each of the first, second, third and fourth plurality of panels includes at least three panels.

30. The blank according to claim 29, wherein each of the first, second and third plurality of panels includes at least four panels.

31. The blank according to claim 29, wherein for each plurality of panels of the first, second, third and fourth plurality of panels, a plurality of tabs is connected to the plurality of panels.

32. The blank according to claim 24, wherein each of the first, second and third panels is triangular.

33. The blank according to claim 24, wherein:

each panel of the second plurality of panels includes opposite first and second edges, the first edge of the first panel of the second plurality of panels is foldably connected to the second edge of the central panel, the second edge of the first panel of the second plurality of panels is connected at a first fold line of the second plurality of fold lines to the first edge of a second panel of the second plurality of panels, the second edge of the second panel of the second plurality of panels is connected at a second fold line of the second plurality of fold lines to the first edge of a third panel of the second plurality of panels, the second edge of the third panel of the second plurality of panels is connected at a third fold line of the second plurality of fold lines to the first edge of a fourth panel of the second plurality of panels, and each of the first, second and third panels of the second plurality of panels is triangular.

34. The blank according to claim 24, wherein:

each panel of the third plurality of panels includes opposite first and second edges;

the first edge of the first panel of the third plurality of panels is foldably connected to the third edge of the central panel;

the second edge of the first panel of the third plurality of panels is connected at a first fold line of the third plurality of fold lines to the first edge of a second panel of the third plurality of panels;

the second edge of the second panel of the third plurality of panels is connected at a second fold line of the third plurality of fold lines to the first edge of a third panel of the third plurality of panels; and the blank further includes (a) a pair of panels, wherein the panels of the pair of panels are spaced apart from one another, each panel of the pair of panels includes opposite first and second edges, and the first edges of the panels of the pair of panels are foldably connected to the third panel of the third plurality of panels, and (b) a fifth panel foldably connected to the second edge of each panel of the pair of panels, so that the pair of panels is positioned between the fifth panel and the third panel of the third plurality of panels.

35. The blank according to claim 34, wherein:

the second edge of the third panel of the third plurality of panels is positioned between the panels of the pair of panels, and an edge of the fifth panel is adjacent the second edge of the third panel, and the edge of the fifth panel and the second edge of the third panel are at least partially separated from one another by cutting.

36. A carton capable of containing at least one article, the carton comprising:

a plurality of panels that are positioned to cooperatively define a cavity for at least partially containing the article, wherein the plurality of panels includes a base panel, an upwardly extending a front panel, an upwardly extending inner rear panel, an upwardly extending right side panel, and an upwardly extending left side panel that is laterally spaced apart form the right side panel;

spanning panels that are positioned between the right and left side panels, wherein the spanning panels (a) are laterally spaced apart from one another so that a portion of the cavity is positioned between the spanning panels, (b) extend forwardly from the inner rear panel, (c) extend rearwardly from the front panel, and (d) extend above and are superposed with the base panel, so that a portion of the cavity is positioned above the spanning panels, and a portion of the cavity is positioned below the spanning panels;

an upwardly extending outer rear panel foldably connected to a rear edge of the base panel, wherein the inner rear panel is positioned between the cavity and the outer rear panel;

a first plurality of panels that are arranged in series with respect to one another and are respectively foldably connected to one another by a first plurality of fold lines, wherein a first panel of the first plurality of panels is foldably connected to a right edge of the outer rear panel, the first plurality of panels includes the right side panel, and fold lines of the first plurality of fold lines extend obliquely with respect to the right edge of the outer rear panel;

a second plurality of panels that are arranged in series with respect to one another and are respectively foldably connected to one another by a second plurality of fold lines, wherein a first panel of the second plurality of panels is foldably connected to a left edge of the outer rear panel, the second plurality of panels includes the left side panel, and fold lines of the second plurality of fold lines extend obliquely with respect to the left edge of the outer rear panel; and a third plurality of panels, wherein at least some of the panels of the third plurality of panels are arranged in series with respect to one another and are respectively foldably connected to one another by a third plurality of fold lines, wherein a first panel of the third plurality of panels is foldably connected to an upper edge of the outer rear panel, and the third plurality of panels includes each of (a) the inner rear panel, (b) the spanning panels, and (c) the front panel.

37. The carton according to claim 36, further comprising a cover panel connected to a forward edge of the base panel for pivoting at least between closed and opened configurations, wherein:

the cover panel at least partially closes an opening to the cavity in the closed configuration, the cover panel at least partially covers the front panel in the closed configuration, and at least a portion of the cover panel is farther away from the cavity in the opened configuration than in the closed configuration, so that the opening to the cavity is at least partially open in the opened configuration.

* * * * *